US011052270B2

(12) United States Patent
Voss et al.

(10) Patent No.: US 11,052,270 B2
(45) Date of Patent: Jul. 6, 2021

(54) VERTICAL FALL ARREST SAFETY DEVICE

(71) Applicant: SAYFA R&D PTY LTD, Boronia (AU)

(72) Inventors: Murray Voss, Boronia (AU); Barry Voss, Boronia (AU)

(73) Assignee: SAYFA R&D PTY LTD, Boronia (AU)

( * ) Notice: Subject to any disclaimer, the term of this patent is extended or adjusted under 35 U.S.C. 154(b) by 38 days.

(21) Appl. No.: 16/429,994

(22) Filed: Jun. 3, 2019

(65) Prior Publication Data

US 2019/0282842 A1 Sep. 19, 2019

Related U.S. Application Data

(63) Continuation-in-part of application No. 16/328,260, filed as application No. PCT/AU2018/050768 on Jul. 24, 2018.

(30) Foreign Application Priority Data

Jul. 24, 2017 (AU) ..... 2017902898
Jan. 30, 2019 (AU) ..... 2019900272

(51) Int. Cl.
*A62B 35/00* (2006.01)
*E06C 7/18* (2006.01)

(52) U.S. Cl.
CPC ..... *A62B 35/0062* (2013.01); *E06C 7/187* (2013.01)

(58) Field of Classification Search
CPC .. A62B 35/0062; E06C 35/0062; E06C 7/187
See application file for complete search history.

(56) References Cited

U.S. PATENT DOCUMENTS 3,762,500 A 10/1973 Sarno
3,885,647 A 5/1975 Acosta
(Continued)

FOREIGN PATENT DOCUMENTS

DE 2626425 A1 * 12/1977 ..... A62B 1/14
EP 1253280 A2 * 10/2002 ..... B66B 5/00
(Continued)

OTHER PUBLICATIONS

UK Search Report dated Nov. 28, 2019 from Application No. GB1908493.8.
(Continued)

*Primary Examiner* — Alvin C Chin-Shue
(74) *Attorney, Agent, or Firm* — Innovation Capital Law Group, LLP; Vic Lin

(57) ABSTRACT

A vertical fall arrest safety device travels along a rail of a vertical track and is configured for quick attachment and detachment anywhere along the rail. The device has a mounting body having side rail engagements configured for slidably engaging behind the edges of a rail of the vertical track in use. The engagements are spaced and staggered so as to receive the rail therebetween when the mounting body is at an angle, and then slidably attach to the rail when the mounting body is twisted into alignment with the rail. The device also has a lever pivotally coupled to the mounting body at a fulcrum. As such, when a downward force is applied to a connection point of a distal end of the lever, an opposite distal end of the lever frictionally engages the rail.

19 Claims, 7 Drawing Sheets

(56) References Cited

U.S. PATENT DOCUMENTS

| | | | | |
|---|---|---|---|---|
| 3,970,400 | A | 7/1976 | Reid | |
| 4,352,409 | A | 10/1982 | Fountain | |
| 4,524,848 | A | 6/1985 | Russo | |
| 4,802,643 | A | 2/1989 | Uys | |
| 4,823,912 | A | 4/1989 | Gould et al. | |
| 4,917,216 | A | 4/1990 | Kimber | |
| 5,238,084 | A * | 8/1993 | Swager | E06C 7/187 182/193 |
| 5,265,696 | A | 11/1993 | Casebolt | |
| 5,560,731 | A | 10/1996 | Kronenberg | |
| 6,161,647 | A * | 12/2000 | Braden | A62B 1/14 182/5 |
| 6,324,988 | B1 | 12/2001 | Svensson | |
| 6,408,587 | B2 | 6/2002 | Cronin et al. | |
| 6,789,647 | B1 * | 9/2004 | Yeh | A62B 1/14 182/100 |
| 6,837,337 | B2 | 1/2005 | Thomas et al. | |
| 6,929,094 | B1 | 8/2005 | Kohlmeier et al. | |
| 7,137,478 | B2 | 11/2006 | Becker | |
| 8,152,115 | B2 | 4/2012 | Blichmann | |
| 8,205,717 | B2 | 6/2012 | Sutton | |
| 9,797,186 | B2 | 10/2017 | Kronenberg et al. | |
| 10,236,821 | B1 | 3/2019 | Atia et al. | |
| 2005/0189172 | A1 | 9/2005 | Becker | |
| 2010/0133040 | A1 * | 6/2010 | London | A62B 1/04 182/3 |
| 2011/0011679 | A1 | 1/2011 | Leng | |
| 2012/0247869 | A1 | 10/2012 | Anderson | |
| 2014/0000191 | A1 | 1/2014 | Snyker et al. | |
| 2015/0090531 | A1 | 4/2015 | Yang | |

FOREIGN PATENT DOCUMENTS

| | | | | |
|---|---|---|---|---|
| EP | 2248989 | A1 | 11/2010 | |
| FR | 2437846 | A1 * | 4/1980 | A62B 35/04 |
| FR | 2606649 | A1 * | 5/1988 | A62B 35/04 |
| FR | 2617650 | A1 * | 1/1989 | H01R 4/64 |
| GB | 1092856 | A | 11/1967 | |
| GB | 1452204 | A | 10/1976 | |
| JP | 2007270452 | A | 10/2007 | |
| NL | 2017371 | B1 | 3/2018 | |
| WO | 0238222 | A1 | 5/2002 | |
| WO | 2017070314 | A1 | 4/2017 | |
| WO | WO-2017122035 | A1 * | 7/2017 | A62B 35/04 |
| WO | 2019018888 | A1 | 1/2019 | |

OTHER PUBLICATIONS https://industrialsafety.honeywell.com/en-us/products/by-category/fall-protection/fall-protection-kits/miller-vi-go-ladder-climbing-safety-systems-cable.

https://www.3m.com/3M/en_US/company-us/all-3m-products/?N=5002385+8709322+8711017+8711405+8720539+8720544+8735085+8737761+3294857497&rt=r3.

https://www.avanti-online.com/products/fps.

https://www.capitalsafety.com/aunzadmin/pages/Product-Category-Overview-Page.aspx?prodCatId=6.

https://www.skylotec.com/eu_en/permanent-systems/products/vertical-fall-arrest-systems/.

International Search Report & Written Opinion dated Sep. 3, 2018 from PCT Application No. PCT/AU2018/050768.

* cited by examiner

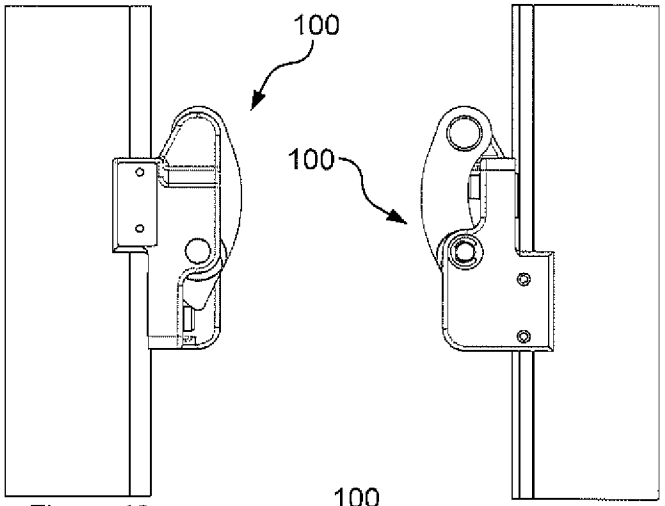
Figure 12
Figure 13
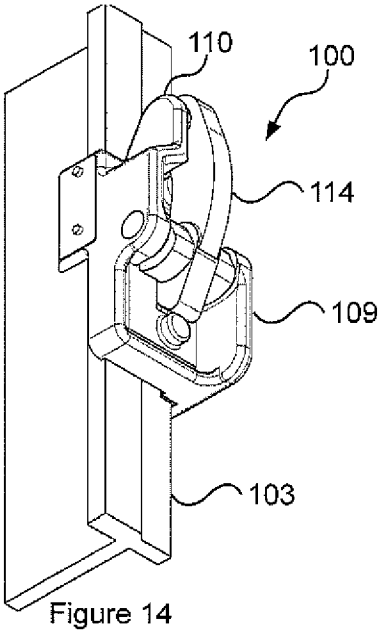
Figure 14
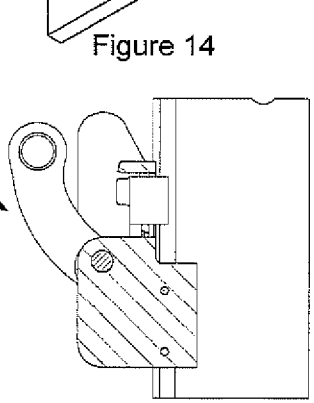
Figure 15
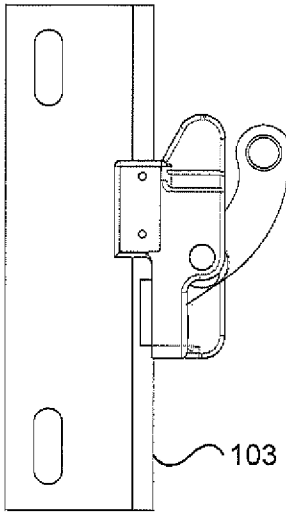
Figure 16
Figure 17

VERTICAL FALL ARREST SAFETY DEVICE

CROSS-REFERENCE TO RELATED APPLICATION

This application is a continuation-in-part of pending U.S. National Stage application Ser. No. 16/328,260 filed Feb. 25, 2019.

FIELD OF THE INVENTION

This invention relates generally to worker fall arresting safety equipment. More particularly, this invention relates to a vertical fall arrest safety device which travels along a rail of a vertical track, to arrest the fall of a user tethered thereto, in the event of a fall.

BACKGROUND

Vertical fall arrest safety devices are attached to a vertical track and are used to arrest the fall of a user in the event of a fall.

For example, U.S. Pat. No. 6,837,337 B2 to Thomas et al. discloses a device having a lever which pivots about a fulcrum to press against a rail. As such, when the lever is pulled by a tether during a fall, the lever presses against the rail to stop the device and therefore arrest the user's fall. However, this device can only be disconnected from the rail by running the device to the bottom end of the rail, which can prove impractical and inconvenient.

The present system provides an improved vertical fall arrest safety device, which can be easily and safely connected and disconnected anywhere along the rail of a vertical track.

SUMMARY OF THE DISCLOSURE

There is provided herein a vertical fall arrest safety device which travels along a rail of a vertical track.

The present device is configured for quick attachment and detachment anywhere along the rail.

Specifically, the device comprises a mounting body having side rail engagements configured for slidably engaging behind the edges of a rail of the vertical track in use. The device has a lever pivotally coupled to the mounting body at a fulcrum. As such, when a downward force is applied to a connection point of a distal end of the lever, an opposite distal end of the lever frictionally engages the rail.

The side rail engagements are spaced along a travel axis of the device and have spacing therebetween, such that the side rail engagements engage the edges of the rail when the travel axis is aligned with an elongate axis of the rail, but which disengage from the edges of the rail when the travel axis is not aligned with the elongate axis of the rail.

As such, the user may easily engage the device to the rail firstly at an angle, and then twist the device into alignment with the rail to connect the device to the rail.

The device may further comprise an automatic latching mechanism, to prevent the disconnection of the device from the rail in use, when a user is tethered to the device.

The latching mechanism may comprise a latching plate, which is deflected by cams of the lever to extend the latches to engage the sides of the rail, to prevent the device from being twisted from the rail.

The cams may be configured such that when the lever is at a non-operative position, the latching plate is not deflected, and the latches do not extend such that the device can be easily connected to the rail at an angle as described above. However, when the lever is at an operative position, the cams deflect the latching plate such that the latches extend to the sides of the rail, such that the device cannot be twisted from the rail and disconnected thereby.

The mounting body of the device may define a guard which obstructs the connection point of the lever, to prevent the lever being moved to the non-operative position when a user is tethered to the device. As such, the device can only be disconnected from the rail once the user is untethered from the device.

According to one aspect, there is provided a vertical fall arrest safety device comprising a mounting body having side rail engagements configured for slidably engaging behind edges of a rail of a vertical track in use, and a lever pivotally coupled to the mounting body at a fulcrum such that a downward force applied to a connection point of the lever causes a distal end of the lever to engage the rail, and wherein the side rail engagements are spaced apart along a travel axis of the device, such that the side rail engagements engage the edges of the rail when the travel axis is aligned with an elongate axis of the rail, and disengage the edges of the rail when the travel axis is not aligned with the elongate axis of the rail.

The device may further comprise a fulcrum pin journalled through apertures of the sides of the mounting body, such that the fulcrum pin engages the lever.

The side rail engagements may be located either side of a pivot axis of the fulcrum pin.

The device may further comprise a coil spring which engages the lever at the fulcrum pin to bias the lever to an operative position.

The mounting body may have an aperture for the distal end of the lever to pass therethrough.

Each side rail engagement may comprise a side portion which extends around a respective edge of the rail, and an orthogonal inward projection which engages behind the edge.

Adjacent corners of the orthogonal inward projections may be profiled to allow spacing therebetween greater than a width of the rail.

The mounting body may define a guard which obstructs the connection aperture, when the lever may be at a non-operative position.

The device may further comprise friction pads engaged by the side rail engagements.

The friction pads may comprise polymeric material.

The device may further comprise a latching mechanism which may be displaced by the lever to engage the edges of the rail in use.

The latching mechanism may comprise a latching plate having orthogonal latches extending therefrom, and wherein the lever may comprise at least one cam which deflects the latching plate when the lever may be at an operative position, to extend the latches to engage the edges of the rail.

The mounting body may comprise slots for the latches to extend therethrough.

Each latch may be located opposite a respective side rail engagement.

The latching plate may be biased towards at least one cam.

The latching plate may accommodate and seat resilient members between the latching plate and the mounting body.

The rail may comprise a thicker rail profile and a thinner rail profile, and wherein one of the side rail engagements may allow spacing less than the thickness of the thicker profile.

The mounting body may comprise a recess to accommodate the thicker rail profile.

According to another aspect, a method of use of the vertical fall arrest safety device may comprise placing the device against a rail of a vertical track at an angle, such that the rail fits between the side rail engagements, and then twisting the mounting body of the device into alignment with the elongate axis of the rail, such that the side rail engagements mate with the edges of the rail.

The method may further comprise attaching an adapter track to a conventional T-sectioned rail, the adapter track comprising a T-sectioned rail engagement profile with side arms, each having a side projection and a distal inward projection integrally defining a channel having a T-shaped cross-section therebetween to accommodate the T-sectioned rail.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which:

FIGS. 12-14 show respective left side, right side and bottom front perspective views of the device, wherein the lever is in a non-operative position;

FIGS. 15-17 show respective bottom front perspective, left side and right side cross-sectional views of the device, wherein the lever is in an operative position;

DESCRIPTION OF EMBODIMENTS

Figure 1B:
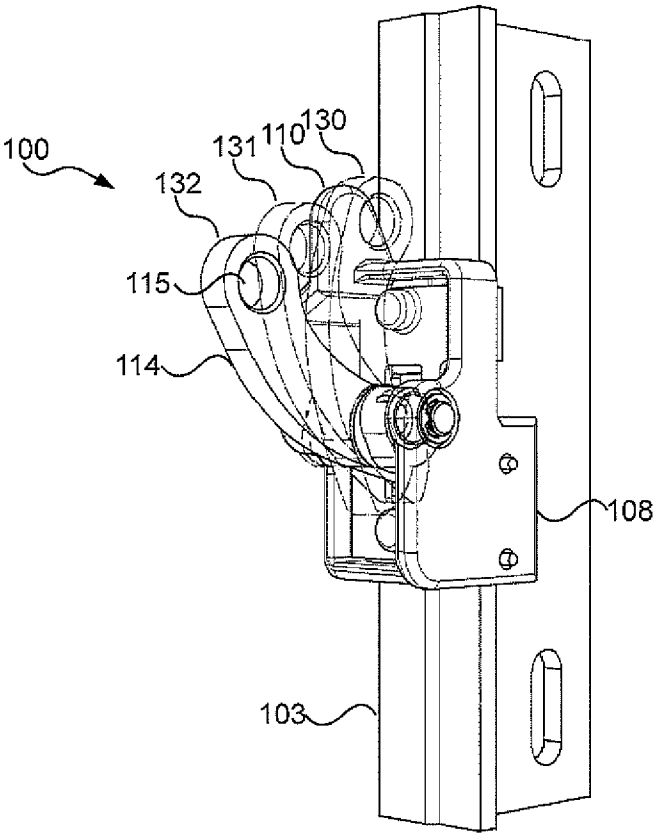
FIGS. 1A and 1B show respective left and right side perspective views of a vertical fall arrest safety device, having a lever in any of three operative positions, in accordance with an embodiment.
Figure 1A:
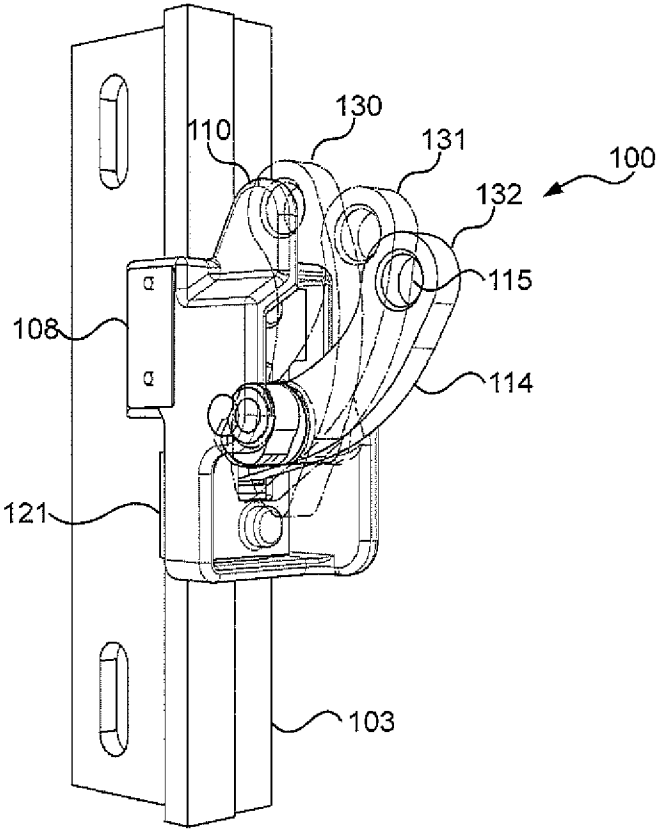
Figure 2B:
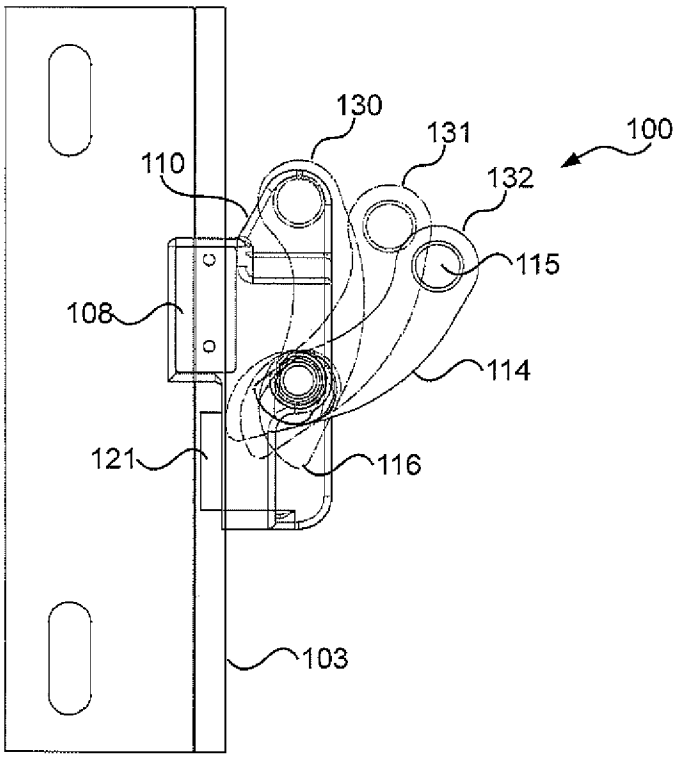
FIGS. 2A and 2B show respective right and left side views of the device.
Figure 2A:
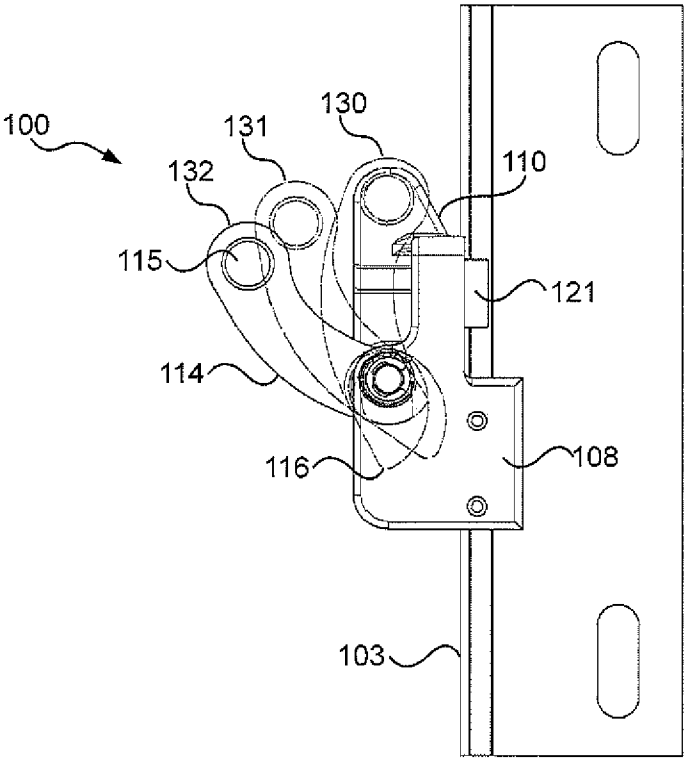
Figure 4:
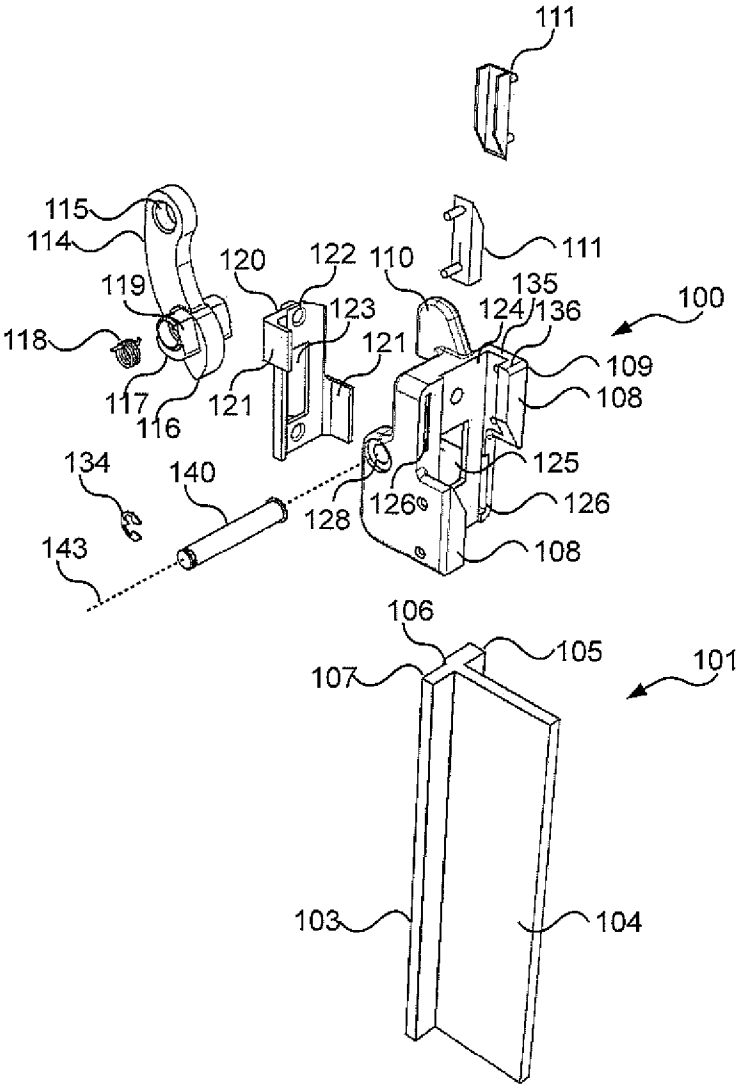
FIGS. 3 and 4 show respective front and rear exploded views of the device and vertical rail, in accordance with an embodiment.
Figure 3:
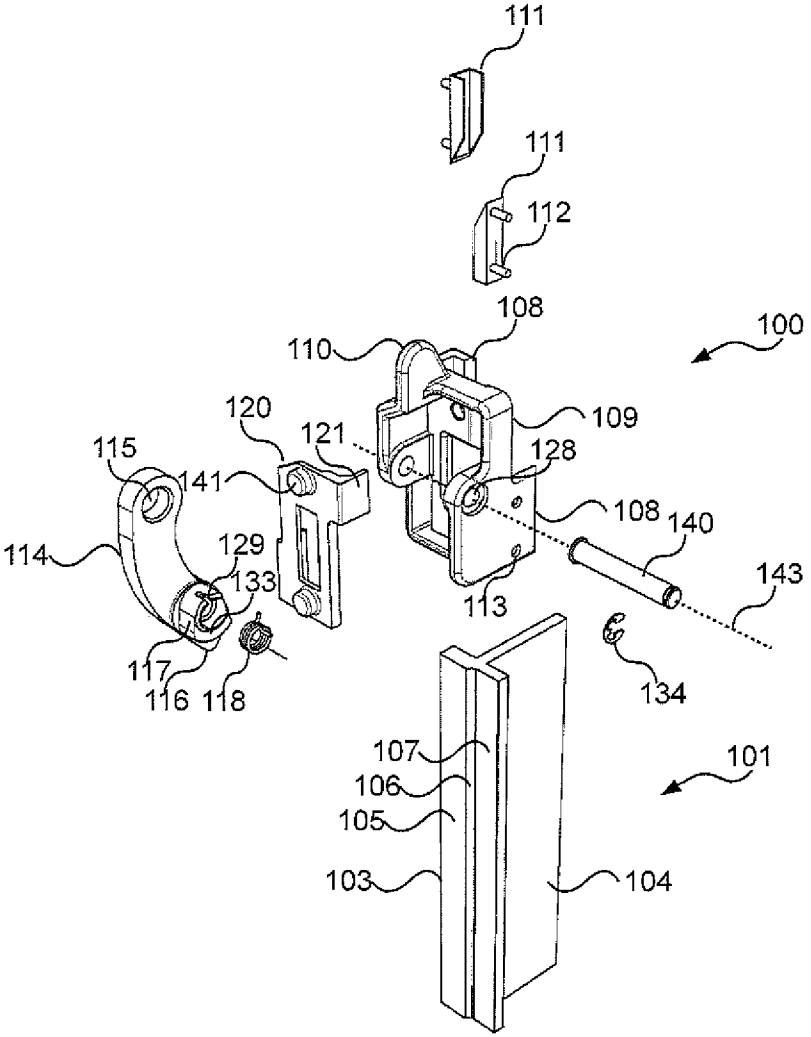

FIGS. 3 and 4 show respective front and rear exploded views of a vertical fall arrest safety device 100. The device 100 comprises a mounting body 109 configured to slide along a vertical track 101. The track 101 may comprise a rail 103 and an orthogonal stem 104. The orthogonal stem 104 may be connected to a vertical structure, such as a ladder or the like, including by way of T-bolt fasteners and bolt hole apertures therethrough.

The device 100 comprises a lever 114 pivotally coupled to the mounting body 109. The lever may comprise collars 117 which engage a fulcrum pin 140 therethrough. The fulcrum pin 140 may be journalled through side pin apertures 128 and secured with a clip washer 134.

The fulcrum pin 140 defines a pivot axis 143, such that the lever 114 pivots about the pivot axis 143.

The mounting body 109 comprises side rail engagements 108. Each side rail engagement 108 may comprise a side portion 135 which extends around each respective edge of the rail 103, and an inward projection 136 which engages just behind each edge, to slidably engage the mounting body 109 to the rail 103.

Figure 8:
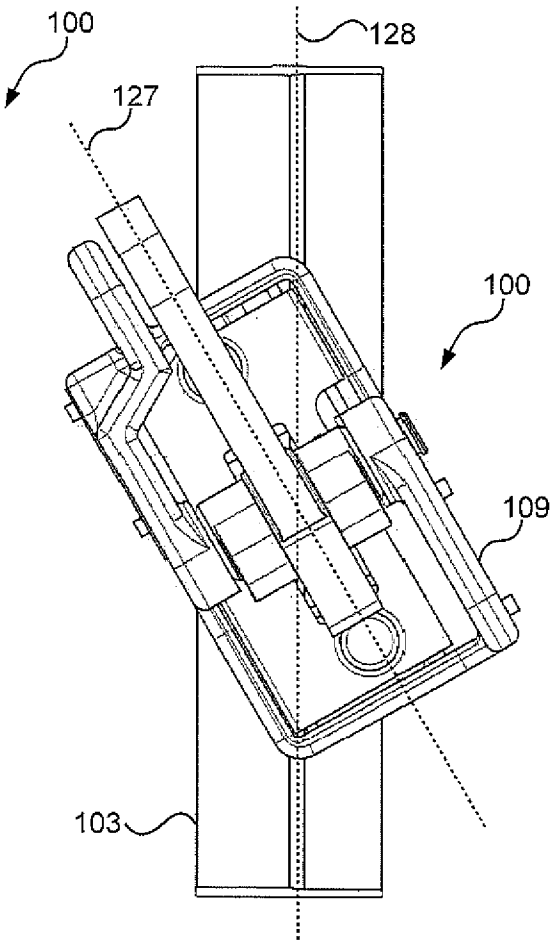
FIGS. 7 and 8 show respective rear perspective and front views of the device being respectively uncoupled from and coupled to the vertical track at an angle, in accordance with an embodiment.
Figure 7:
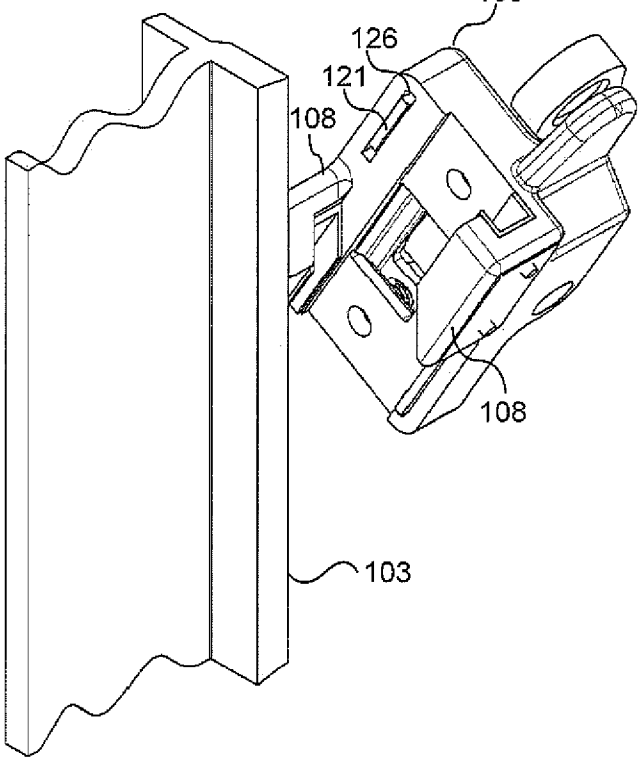

The side rail engagements 108 are located diagonally and spaced apart so as to allow for twist-on connection. Specifically, with reference to FIGS. 7 and 8, the side rail engagements 108 may be located along a travel axis 127 of the mounting body 109 (i.e. top and bottom and side to side), and spaced apart such that the rail 103 can fit between the inward projections 136, when the mounting body 109 is at an angle with respect to the rail 103 as shown.

The spacing between the side rail engagements 108 is slightly greater than the width of the rail 103. Adjacent corners of the inward projections 136 may be profiled as shown to allow for this spacing.

Figure 11:
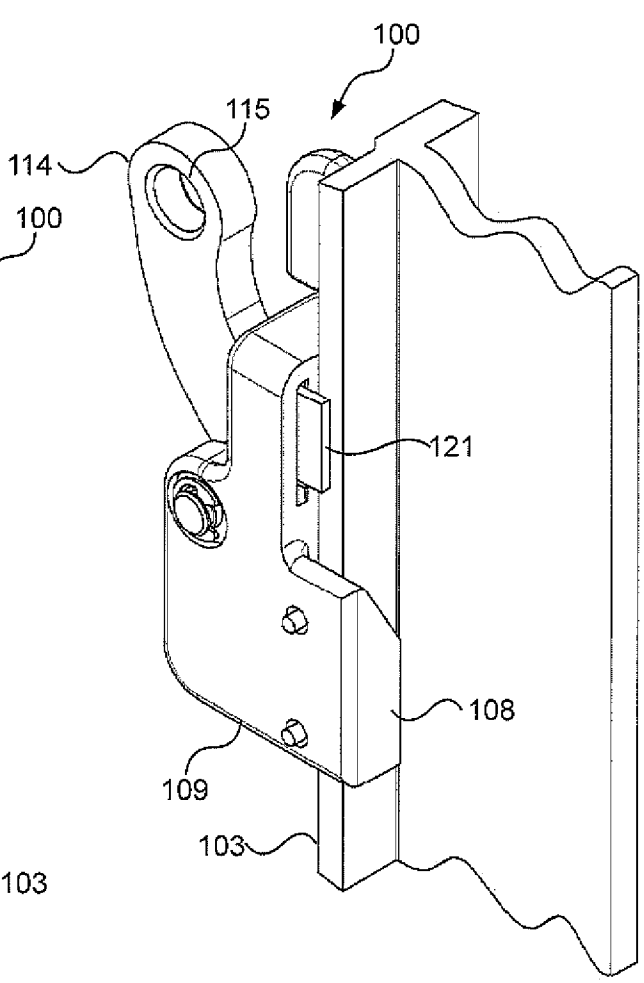
FIGS. 9-11 show respective left side rear perspective, front and right side rear perspective views of the device connected to the vertical track.
Figure 10:
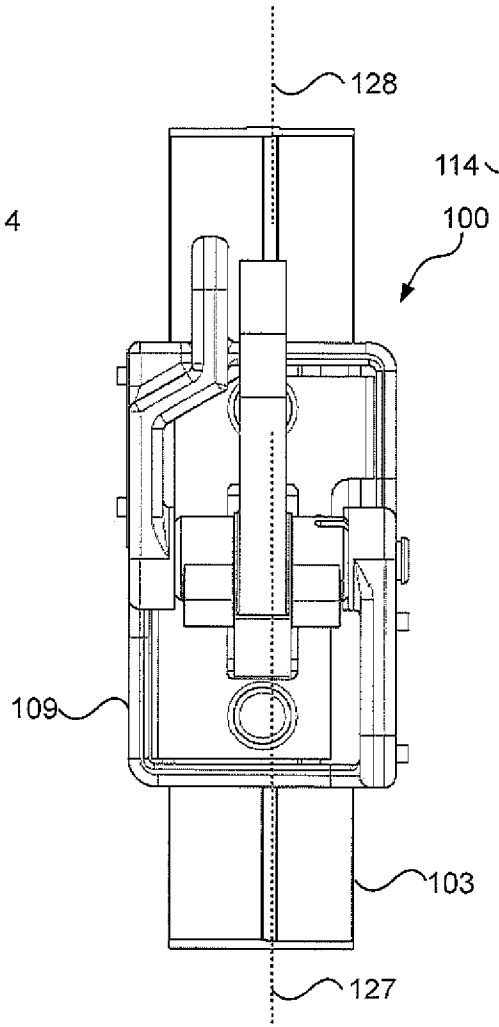
Figure 9:
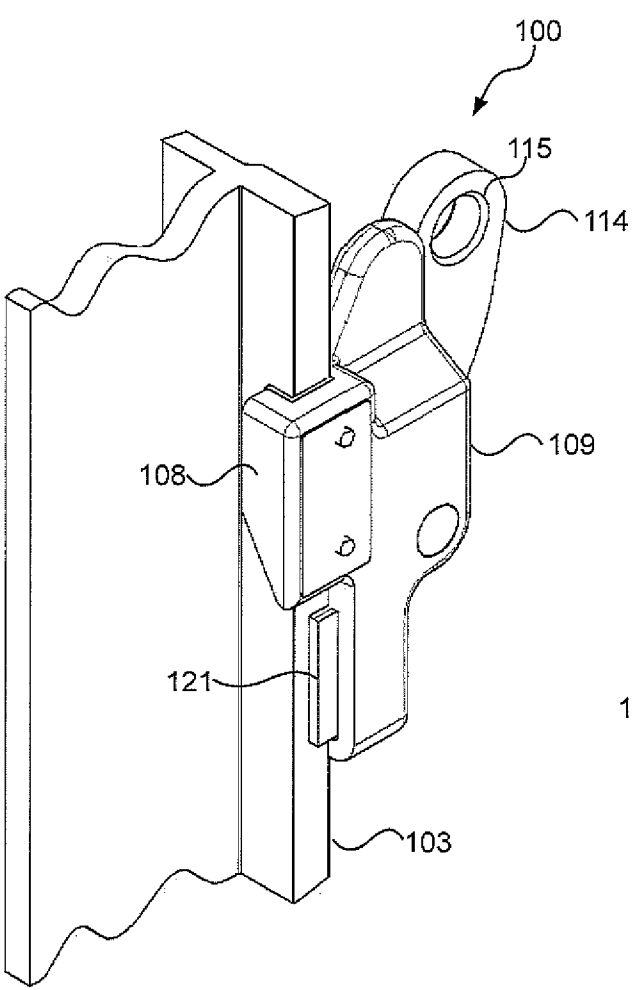

However, when the travel axis 127 of the mounting body 109 is rotated into alignment with an elongate axis 128 of the rail 103, as shown in FIGS. 9-11, the side rail engagements 108 mate in such way that the inward projections 136 thereof engage behind the edges of the rail 103, thereby securing the mounting body 109 to the rail 103, while allowing the mounting body 109 to slide along the rail 103, when thus orientated in this alignment with the rail 103.

The lever 114 may comprise a connection aperture 115, through which a carabiner may be attached to tether a user to the device.

The lever 114 may pivot between, and rest at any of the three operative positions 130, 131 and 132, as shown in FIGS. 1A and 1B and 2A and 2B.

The three operative positions may comprise a non-operative position 130. In the non-operative position 130 the connection aperture 115 may be obstructed by a guard 110, such that a carabiner cannot be attached by a user through the connection aperture 115. The device 100 would be connected to the rail 103 at an angle as described above, when the lever 114 is in the non-operative position 130.

Once the device 100 is secured to the rail 103, the lever 114 rests at the operative position 131.

In the event of a fall by a user, the lever 114 is pulled sharply downwards to the fall arrest position 132, wherein a distal end 116 of the lever 114 passes through a central rectangular aperture 125 of the mounting body 109 to press against the rail 103, thereby immediately arresting any downward travel of the device 100.

An end of a coil spring 118 may locate through a notch 129 of the collar 117, so as to bias the lever 114 to at least one of the three operative positions 130, 131 and 132. For example, the coil spring 118 may be configured to bias the lever 114 to the fall arrest position 132, such that the device 100 is caused to arrest by default. Alternatively, the coil spring 118 may bias the lever 114 to the non-operative position 130 or the operative position 131, so that the device 100 is able to travel along the vertical track 101 by default.

The device may comprise a pair of friction pads 111 of such materials as polymers, which locate within the side rail engagements 108 to prevent the device 100 slipping down the vertical track 101. Each pad 111 may comprise protrusions 112, which locate through corresponding apertures 113 in the sides of the mounting body 109.

The device 100 may further comprise a latching mechanism, to prevent disconnection of the device 100 from the vertical track 101 when in use. The latching mechanism may comprise a latching plate 120 having a central rectangular aperture 123 and latches 121.

The latching plate 120 may be deflected by the lever 114, such that the latches 121 extend through the respective slots 126 to engage the edges of the rail 103. Each latch 121 may locate opposite a respective side edge engagement 108, to prevent the mounting body 109 from being rotated out of alignment with the vertical track 101 for disconnection.

The lever 114 may further have cams 133 which deflect the latching plate 120, such that the latches 121 extend through the slots 126 to engage the edges of the rail 103, when the lever 114 is at the operative position 131. Each collar 117 may comprise a chamfer 119 to allow the latching plate 120 to reset when the lever 114 is at the non-operative position 130.

When the lever 114 is at the non-operative position 130 as shown in FIGS. 12-14, the chamfers 119 locate adjacent to the latching plate 120, thereby allowing the latching plate 120 to move away from the mounting body 109, such that the latches 121 do not extend to engage the edges of the rail 103.

However, at the operative position 131 as shown in FIGS. 15-17, the chamfers 119 have moved away from the latching plate 120, and the cams 133 press against the latching plate 120, such that the latches 121 extend through the respective slots 126 to engage the edges of the rail 103.

The latching plate 120 may comprise upper and lower accommodations 122, to seat resilient members 141 of such materials as rubber, between the latching plate 120 and the mounting body 109, to bias the plate away from the body.

The device 100 and the vertical track 101 may be keyed, so that the device 100 cannot be incorrectly secured upside down to the vertical track 101. In this regard, the rail 103 may comprise a thicker left profile 105 and a thinner right profile 107, having a step-down 106 therebetween.

Figure 5:
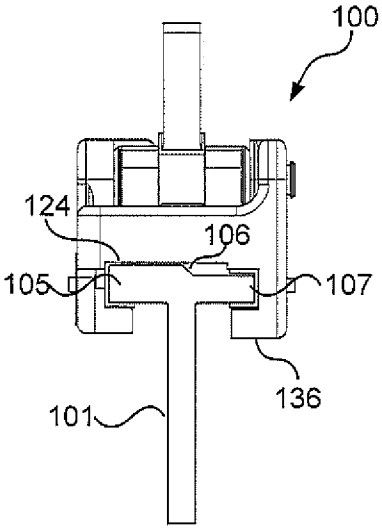
FIG. 5 shows a bottom plan view of the device connected to the vertical track.
Figure 6:
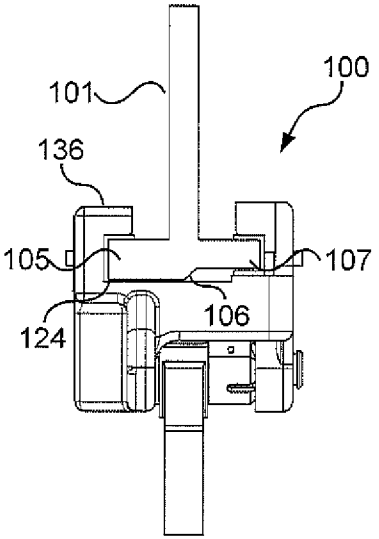
FIG. 6 shows a top plan view of the device connected to the vertical track.

One of the side rail engagements 108 may allow spacing less than the thickness of the thicker left profile 105, such that the profile cannot be inserted therein. In this event, the mounting body 109 may define a recess 124 which accommodates the thicker profile 105 as shown in FIGS. 5 and 6, only when the mounting body 109 is correctly aligned and orientated.

Figure 20:
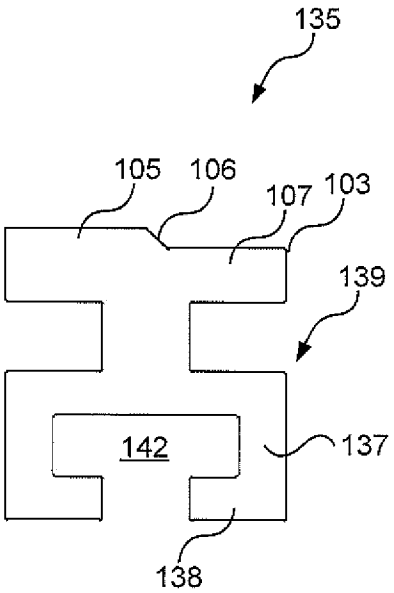
FIG. 20 shows a typical adapter track for retro-fitting to a T-sectioned rail.
Figure 19:
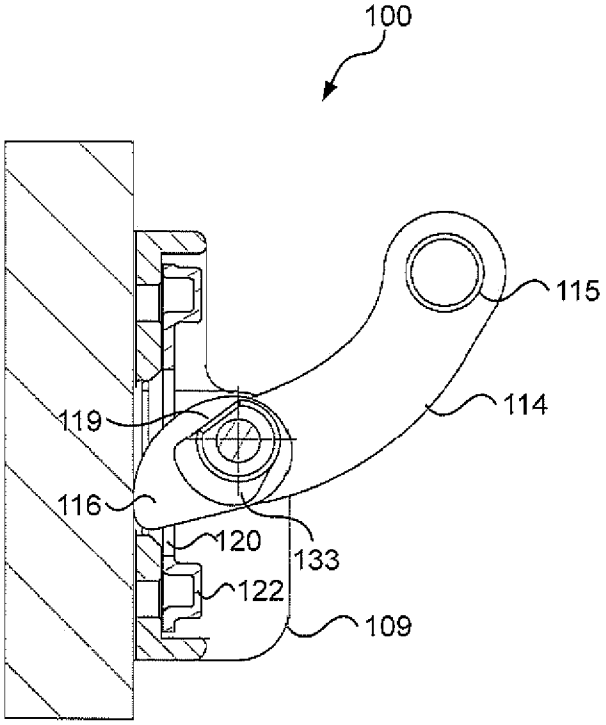
FIGS. 18-19 show respective bottom front perspective and left side cross-sectional views of the device, wherein the lever is pulled to a fall arrest position.
Figure 18:
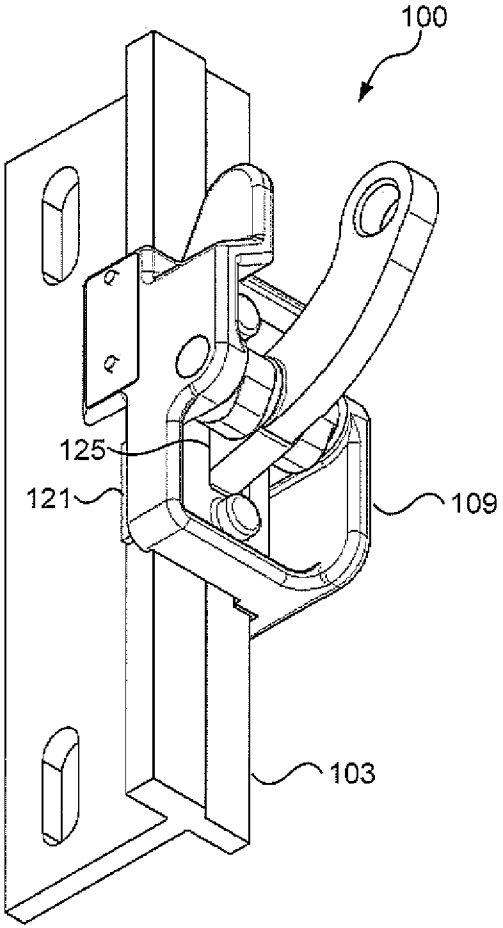

FIG. 20 shows a typical adapter track 135 for connecting a keyed rail 103 of the aforesaid description to a conventional T-sectioned rail, and having an identical thicker profile 105, stepdown 106 and thinner profile 107. The typical adapter track 135 comprises a T-sectional rail engagement profile 139 with side arms, each having a side projection 137 and a distal inward projection 138, integrally defining a channel 142 having a T-shaped cross-section therebetween to accommodate the T-sectioned rail.

As such, the typical adapter track 135 may be connected to a conventional T-sectioned rail for the attachment of the vertical fall arrest safety device 100. Furthermore the adaptor track 135 may be profiled to different configurations and dimensions of projections 137 and 138 and channel 142, to suit various other rail cross-sections.

The aforegoing description, for purposes of explanation, used specific nomenclature to provide a thorough understanding of the invention. However, it will be apparent to one skilled in the art that specific details are not required in order to practise the invention. Thus, the aforegoing descriptions of specific embodiments of the invention, are presented for purposes of illustration and description. They are not intended to be exhaustive or to limit the invention to the precise forms disclosed, as obviously many modifications and variations are possible in view of the above teachings. The embodiments were chosen and described in order to best explain the principles of the invention and its practical applications, thereby enabling others skilled in the art to best utilise the invention and various embodiments with various modifications, as are suited to the particular use contemplated. It is intended that the following claims and their equivalents define the scope of the invention.

The invention claimed is:

1. A vertical fall arrest safety device comprising:

a mounting body having side rail engagements configured for slidably engaging behind edges of a rail of a vertical track in use;

a lever pivotally coupled to the mounting body at a fulcrum, such that a downward force applied to a connection point of the lever causes a distal end of the lever to engage the rail, the lever movable between a non-operative position, an operative position and a fall arrest position; and a latching mechanism movable from a non-rail engagement position to a rail engagement position via movement of the lever from the non-operative position to the operative position, the rail engagement position causing the latching mechanism to engage the edges of the rail in use to prevent the mounting body from being rotated out of alignment with the vertical track for disconnection, wherein the side rail engagements are spaced apart along a travel axis of the device, such that the side rail engagements engage the edges of the rail when the travel axis is aligned with an elongate axis of the rail, and disengage the edges of the rail when the travel axis is not aligned with the elongate axis of the rail.

2. The device as claimed in claim 1, further comprising a fulcrum pin journalled through apertures of sides of the mounting body, such that the fulcrum pin engages the lever.

3. The device as claimed in claim 2, wherein the side rail engagements are respectively located opposite sides of a pivot axis of the fulcrum pin.

4. The device as claimed in claim 2, further comprising a coil spring which engages the lever at the fulcrum pin to bias the lever to an operative position.

5. The device as claimed in claim 1, wherein the mounting body has an aperture for the distal end of the lever to pass therethrough.

6. The device as claimed in claim 1, wherein each side rail engagement comprises a side portion which extends around a respective edge of the rail, and an orthogonal inward projection which engages behind the edge.

7. The device as claimed in claim 6, wherein adjacent corners of the orthogonal inward projections are profiled to allow spacing therebetween greater than a width of the rail.

8. The device as claimed in claim 1, wherein the mounting body defines a guard which obstructs the connection aperture, when the lever is at a non-operative position.

9. The device as claimed in claim 1, further comprising friction pads engaged by the side rail engagements.

10. The device as claimed in claim 9, wherein the friction pads comprise polymeric material.

11. The device as claimed in claim 1, wherein the latching mechanism comprises a latching plate having orthogonal latches extending therefrom, and wherein the lever comprises at least one cam which deflects the latching plate when the lever is at an operative position, to extend the latches to engage the edges of the rail.

12. The device as claimed in claim 11, wherein the mounting body comprises slots for the latches to extend therethrough.

13. The device as claimed in claim 11, wherein each latch is located opposite a respective side rail engagement.

14. The device as claimed in claim 11, wherein the latching plate is biased towards the at least one cam.

15. The device as claimed in claim 14, wherein the latching plate accommodates and seats resilient members between the latching plate and the mounting body.

16. The device as claimed in claim 1, wherein one of the side rail engagements has a spacing less than a thickness of a profile of one side of the rail when the device is attached to the rail in use thereof.

17. The device as claimed in claim 16, wherein the mounting body comprises a recess to accommodate the thicker rail profile.

18. A method of use of a vertical fall arrest safety device as claimed in claim 1, the method comprising:

placing the device against a rail of a vertical track at an angle, such that the rail fits between the side rail engagements; and twisting the mounting body of the device into alignment with the elongate axis of the rail, such that the side rail engagements mate with the edges of the rail.

19. The method as claimed in claim 18, wherein the method further comprises attaching an adapter track to a conventional T-sectioned rail, the adapter track comprising a T-sectioned rail engagement profile with side arms, each having a side projection and a distal inward projection integrally defining a channel having a T-shaped cross-section therebetween to accommodate the T-sectioned rail.

* * * * *